US011873586B2

(12) United States Patent
Luo et al.

(10) Patent No.: US 11,873,586 B2
(45) **Date of Patent: *Jan. 16, 2024**

(54) CUT-RESISTANT YARN STRUCTURE

(71) Applicant: HONEYWELL INTERNATIONAL INC., Charlotte, NC (US)

(72) Inventors: Rui Luo, Shanghai (CN); Jing Xu, Shanghai (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/813,855

(22) Filed: Jul. 20, 2022

(65) Prior Publication Data

US 2023/0008521 A1 Jan. 12, 2023

Related U.S. Application Data

(63) Continuation of application No. 16/714,929, filed on Dec. 16, 2019, now Pat. No. 11,427,938.

(30) Foreign Application Priority Data

Dec. 18, 2018 (CN) ..... 201811548363.3

(51) Int. Cl.
*D02G 3/44* (2006.01)
*D02G 3/38* (2006.01)

(52) U.S. Cl.
CPC ..... *D02G 3/442* (2013.01); *D02G 3/38* (2013.01); *D10B 2501/041* (2013.01)

(58) Field of Classification Search
None
See application file for complete search history.

(56) References Cited

U.S. PATENT DOCUMENTS 4,384,449 A 5/1983 Byrnes et al.
5,514,457 A 5/1996 Fels et al.
(Continued)

FOREIGN PATENT DOCUMENTS

CN 1148874 A 4/1997
CN 1261932 A 8/2000
(Continued)

OTHER PUBLICATIONS

CN Office Action dated Jul. 4, 1904 for CN Application No. 201811548363.
(Continued)

*Primary Examiner* — Shawn Mckinnon
(74) *Attorney, Agent, or Firm* — Alston & Bird LLP

(57) ABSTRACT

Apparatuses and associated methods of manufacturing are described that provide for cut-resistant yarn structures. An example cut-resistant yarn structure includes a first cut-resistant core filament a second cut-resistant core filament. The yarn structure further includes a first covering yarn that is wound over the first cut-resistant core filament and the second cut-resistant core filament. The first covering yarn includes a core-spun yarn in which staple fibers are spun over a third cut-resistant core filament. The yarn structure also includes one or more covering layers wound over the first covering yarn that may serve as the exterior layer for the cut-resistant yarn structure. In some instances, the first and second cut-resistant core filaments include a core-spun yarn in which staple fibers are spun over the first cut-resistant core filament and/or the second cut-resistant core filament.

18 Claims, 7 Drawing Sheets

(56) References Cited

U.S. PATENT DOCUMENTS

| | | | |
|---|---|---|---|
| 5,597,649 | A | 1/1997 | Sandor et al. |
| 5,632,137 | A | 5/1997 | Kolmes et al. |
| 5,806,295 | A | 9/1998 | Robins et al. |
| 5,845,476 | A | 12/1998 | Kolmes |
| 8,074,436 | B2 | 12/2011 | Hardee et al. |
| 2003/0074879 | A1 | 4/2003 | Patrick |
| 2004/0091705 | A1 | 5/2004 | Hanyon et al. |
| 2005/0022494 | A1 | 2/2005 | Piat |
| 2005/0025950 | A1 | 2/2005 | Hanyon et al. |
| 2005/0086924 | A1 | 4/2005 | Kolmes |
| 2008/0098501 | A1 | 5/2008 | Takata |
| 2014/0000750 | A1 | 1/2014 | Carrara et al. |
| 2014/0090349 | A1 | 4/2014 | Fisher et al. |
| 2015/0118425 | A1 | 4/2015 | Dapsalmon |
| 2015/0181956 | A1 | 7/2015 | Andrews et al. |
| 2015/0220146 | A1 | 8/2015 | Fisher et al. |
| 2018/0016713 | A1 | 1/2018 | Sugimoto et al. |
| 2018/0134609 | A1 | 5/2018 | De Ridder et al. |
| 2020/0325604 | A1 | 10/2020 | Luo et al. |

FOREIGN PATENT DOCUMENTS

| | | | |
|---|---|---|---|
| CN | 1886539 | A | 12/2006 |
| CN | 201006920 | Y | 1/2008 |
| CN | 201343602 | Y | 11/2009 |
| CN | 201343603 | Y | 11/2009 |
| CN | 201343604 | Y | 11/2009 |
| CN | 102292484 | A | 12/2011 |
| CN | 202509192 | U | 10/2012 |
| CN | 104452007 | A | 3/2015 |
| CN | 204185648 | U | 3/2015 |
| CN | 104746200 | A | 7/2015 |
| CN | 104963052 | A | 10/2015 |
| CN | 105274692 | A | 1/2016 |
| CN | 106192120 | A | 12/2016 |
| CN | 106795663 | A | 5/2017 |
| CN | 206376048 | U | 8/2017 |
| CN | 206553692 | U | 10/2017 |
| CN | 107771166 | A | 3/2018 |
| GB | 2018323 | A | 10/1979 |
| JP | S63-196727 | | 8/1988 |
| KR | 1660027 | B1 | 9/2016 |
| TW | M521080 | U | 5/2016 |
| WO | 2004/042123 | A2 | 5/2004 |
| WO | 2017/219926 | A1 | 12/2017 |

OTHER PUBLICATIONS

CN Office Action dated Jun. 16, 2022 for CN Application No. 201811548363.

CN Office Action, including Search Report, dated Jan. 4, 2022 for CN Application No. 201811548363.

Communication about intention to grant a European patent dated Jan. 4, 2022 for EP Application No. 18898945.

Communication about intention to grant a European patent received for EP Application No. 18898945.3, dated Jan. 4, 2022, 6 pages.

Corrected Notice of Allowability received for U.S. Appl. No. 16/714,929, dated May 11, 2022, 4 pages.

Decision to grant a European patent dated May 12, 2022 for EP Application No. 18898945.

Decision to grant a European patent received for European Application No. 18898945.3, dated May 12, 2022, 2 pages.

English Translation of CN Office Action dated Jan. 4, 2022 for CN Application 201811548363.

English Translation of CN Office Action dated Jan. 4, 2022 for CN Application No. 201811548363.

English Translation of CN Office Action dated Jun. 16, 2022 for CN Application No. 201811548363.

European search opinion dated Jul. 5, 2021 for EP Application No. 18898945.

European search opinion dated May 29, 2020 for EP Application No. 19215443.

European Search Report and Search Opinion Received for EP Application No. 18898945.3, dated Jul. 5, 2021, 5 pages.

European search report dated May 29, 2020 for EP Application No. 19215443.

Extended European Search Report for Application No. 19215443.3 dated May 29, 2020, 9 pages.

International Search Report and Written Opinion for PCT Application No. PCT/CN2018/071347, dated Sep. 20, 2018.

International Search Report of the International Searching Authority for PCT/CN2018/07134 7 dated Sep. 20, 2018.

Machine translation of CN 104452007 (Year: 2015).

Non-Final Office Action received for U.S. Appl. No. 16/714,929, dated Dec. 1, 2021, 8 pages.

Non-Final Office Action received for U.S. Appl. No. 16/955,180, dated Dec. 1, 2021, 9 pages.

Non-Final Rejection dated Dec. 1, 2021 for U.S. Appl. No. 16/714,929.

Notice of Allowance and Fees Due (PTOL-85) dated Apr. 20, 2022 for U.S. Appl. No. 16/714,929.

Notice of Allowance and Fees Due (PTOL-85) dated May 11, 2022 for U.S. Appl. No. 16/714,929.

Notice of Allowance received for U.S. Appl. No. 16/714,929, dated Apr. 20, 2022, 7 pages.

Notice of Allowance received for U.S. Appl. No. 16/955,180, dated Apr. 20, 2022, 7 pages.

Notice of Allowance received for U.S. Appl. No. 16/955,180, dated Jun. 23, 2022, 5 pages.

Notice of Allowance received for U.S. Appl. No. 16/955,180, dated May 12, 2022, 4 pages.

Supplementary European search report dated Jul. 5, 2021 for EP Application No. 18898945.

Written Opinion for International Patent Application No. PCT/CN2018/071347 dated Sep. 20, 2018, 4 pages.

CN Office Action dated Sep. 30, 2022 for CN Application No. 201811548363.

EP Office Action dated Mar. 31, 2023 for EP Application No. 19215443, 5 page(s).

European search report dated Feb. 16, 2023 for EP Application No. 22165643.

CN Notice of Allowance, including Search Report dated Jun. 29, 2023 for CN Application No. 201811548363, 5 page(s).

English Translation of CN Notice of Allowance, including Search Report dated Jun. 29, 2023 for CN Application No. 201811548363, 2 page(s).

CUT-RESISTANT YARN STRUCTURE

CROSS-REFERENCE TO RELATED APPLICATIONS

This application is a continuation of U.S. Non-Provisional application Ser. No. 16/714,929 filed Dec. 16, 2019, which claims priority to International Application No. PCT/CN2018/071347 filed Jan. 4, 2018, the content of this application is hereby incorporated by reference in its entirety.

TECHNOLOGICAL FIELD

Example embodiments of the present application relate generally to high performance materials, and, more particularly, to yarn structures and composites.

BACKGROUND

High performance materials and associated yarn structures may be manufactured by combining separate threads or filaments and may include winding and/or twisting operations to form these yarn structures. In some instances, yarns of different configurations and/or materials are used together so as to form a composite yarn structure. Yarns may also be knitted or woven to create cloth, and this cloth may be used to create garments such as gloves, sleeves, shirts, pants, socks, coverings, and the like. Through applied effort, ingenuity, and innovation, many identified deficiencies with existing yarn structures and associated composites have been solved by developing solutions that are included in embodiments of the present disclosure, many examples of which are described in detail herein.

BRIEF SUMMARY

Example embodiments of the present disclosure are directed to a cut-resistant yarn structure and associated methods of manufacturing. An example cut-resistant yarn structure may include a first cut-resistant core filament and a second cut-resistant core filament. A first covering yarn may also be included that is wound over the first cut-resistant core filament and the second cut-resistant core filament. The first covering yarn may include a core-spun yarn in which staple fibers are spun over a third cut-resistant core filament. The cut-resistant yarn structure may further include one or more covering layers wound over the first covering yarn.

In some embodiments, the first cut-resistant core filament includes one of basalt, steel, or steel alloy. In such an embodiment and others, the second cut-resistant core filament may include one of basalt, steel, high performance polyethylene (HPPE), aramid, or steel alloy. Furthermore, the third cut-resistant core filament of the core-spun first covering yarn may also include one of basalt, steel, or steel alloy.

In some embodiments, the staple fibers of the core-spun first covering yarn may include polyester, PE series-polyester, polyethylene, high performance polyethylene (HPPE), high molecular weight polyethylene (HMWPE), regenerated cellulose, moisture management material, or a blended combination thereof.

In other embodiments, the staple fibers of the core-spun first covering yarn may include fire retardant regenerated cellulose, polyimide, para-aramid, polyacrylonitrile (PAN), or a blended combination thereof.

In some cases, the first cut-resistant core filament may also include a core-spun yarn in which staple fibers are spun over the first cut-resistant core filament. Similarly, in such cases and others, the second cut-resistant core filament may include a core-spun yarn in which staple fibers are spun over the second cut-resistant core filament.

In some embodiments, the one or more covering layers may each include polyester, PE series-polyester, polyethylene, high performance polyethylene (HPPE), high molecular weight polyethylene (HMWPE), regenerated cellulose, moisture management material, or a blended combination thereof.

In other embodiments, the one or more covering layers may each include fire retardant regenerated cellulose, polyimide, para-aramid, polyacrylonitrile (PAN), or a blended combination thereof.

In some further embodiments, the cut-resistant yarn structure also includes a second covering yarn wound over the first cut-resistant core filament and the second cut-resistant core filament. In such an embodiment, the second covering yarn may also include a core-spun yarn in which staple fibers are spun over a fourth cut-resistant core filament.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Overview

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The term "comprising" means including but not limited to, and should be interpreted in the manner it is typically used in the patent context. The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment). If the specification describes something as "exemplary" or an "example," it should be understood that refers to a non-exclusive example.

As discussed herein, the example embodiment may be described with reference to a yarn structure that includes various cores, filaments, yarns, coverings, and the like. In this regard, the yarn structure as described and claimed may refer to a composite yarn structure. For the sake of clarity of description, the example embodiments of the present application are herein described with reference to a "yarn structure", but may equally and interchangeably refer to composite yarn structures.

Figure 1A:
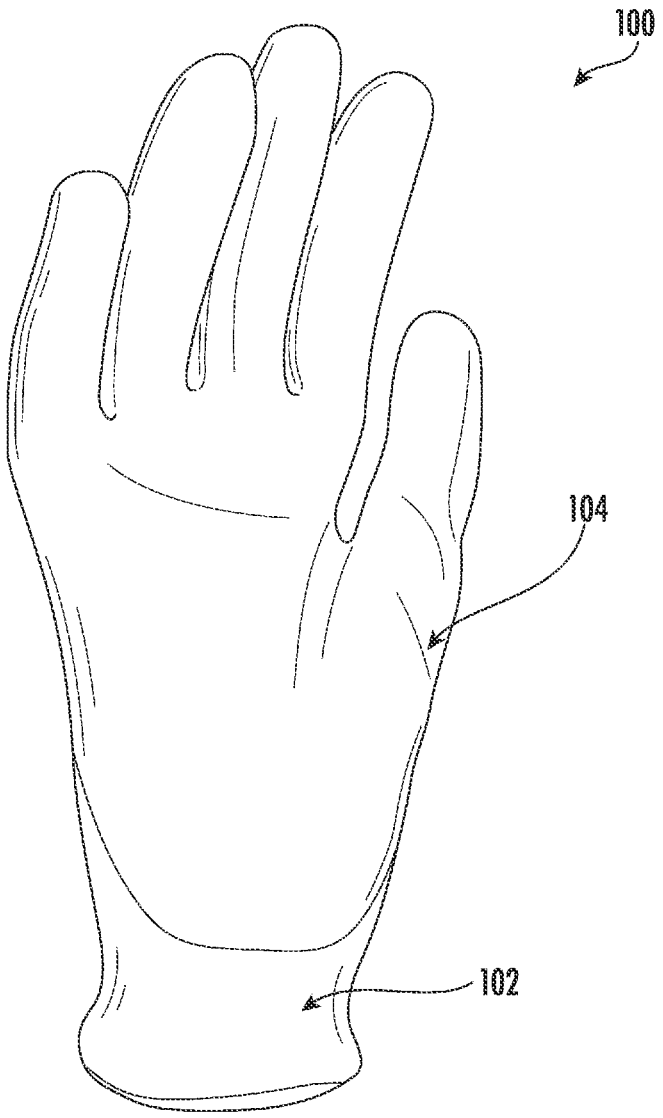
FIGS. 1A-1B illustrate an example cut-resistant glove for implementing example cut-resistant yarn structures of the present disclosure.
Figure 1B:
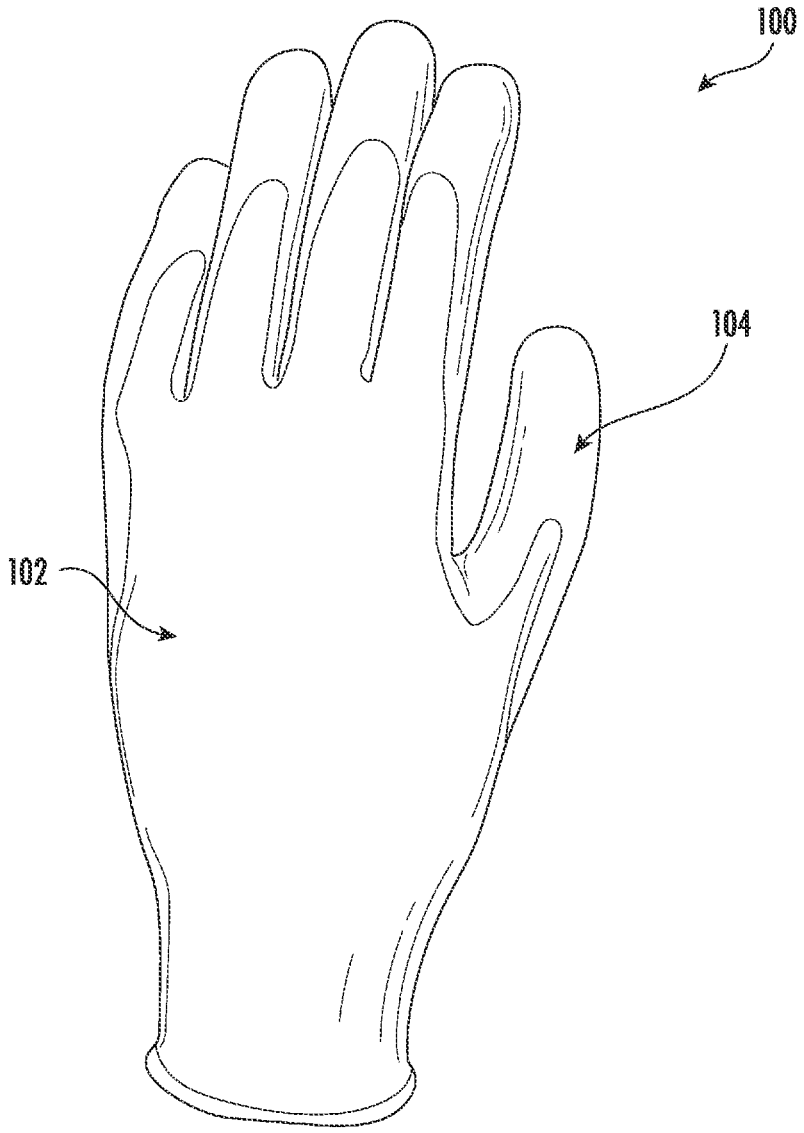

With reference to FIGS. 1A-1B, a cut-resistant glove 100 for implementing example cut-resistant yarn structures is illustrated. As shown, the cut-resistant glove 100 may be manufactured or otherwise formed of cut-resistant cloth 102. As described hereafter with reference to FIGS. 2A-2B, the cut-resistant cloth 102 of the present application may be created from (e.g., woven, knitted, or the like) example cut-resistant yarn structures (e.g., yarn structure 200 in FIG. 3A). While illustrated and described with reference to cut-resistant yarn structures used in forming a cut-resistant glove 100, the present disclosure contemplates that the cut-resistant yarn structures described herein may equally be used to form any garment (e.g., pants, shirts, jackets, coverings, or the like) without limitation. Furthermore, the cut-resistant glove 100 may further include a coated material 104 (e.g., nitrile rubber, natural rubber, polyurethane (PU) rubber, neoprene rubber, polyvinyl chloride (PVC) rubber, wax, latex, or the like) applied to the cut-resistant cloth 102 based upon the intended use of the cut-resistant glove 100. These coated materials 104 may be applied via micro foaming, sandy finish, smooth finish, and/or any other application process known in the art.

Figure 2A:
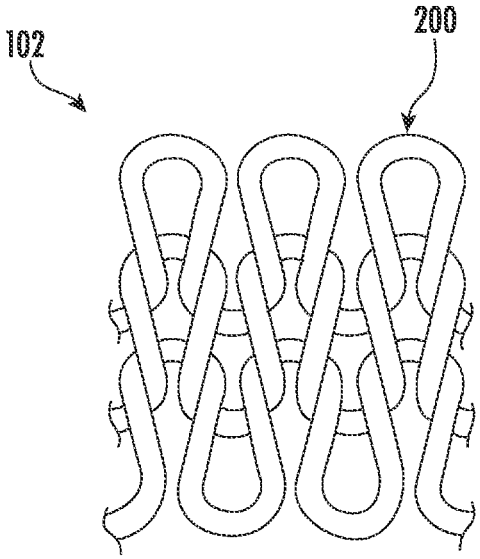
FIGS. 2A-2B illustrate an example knitting pattern for implementing example cut-resistant yarn structures of the present disclosure.
Figure 2B:
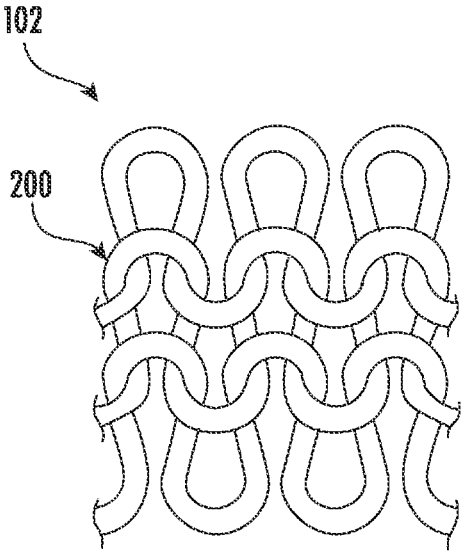

With reference to FIGS. 2A-2B, an example cut-resistant cloth 102 for implementing the example cut-resistant yarn structures of the present disclosure is illustrated. As would be evident to one of ordinary skill in the art in light of the present disclosure, the cut-resistant cloth 102 may be manufactured by any suitable operation or method known in the art. By way of example, the cut-resistant cloth 102 may be woven, knitted, felted or the like without limitation. In some instances, the cut-resistant cloth 102 may be referred to as a cut-resistant fabric or as a cut-resistant textile. In an example embodiment, the cut-resistant cloth 102 is formed at least in part of a first cut-resistant yarn structure (e.g., yarn structure 200). In this regard, the present disclosure contemplates that the cut-resistant cloth 102 may be a hybrid construction and include yarns, adhesives, and/or materials other than the cut-resistant yarn structure of the present disclosure. As shown in FIGS. 2A-2B, the cut-resistant cloth 102 may be formed as a knitted cloth but may also be formed via non-knitting techniques, such as using weaving or felting techniques.

Embodiments of the present disclosure include cut-resistant yarns and cut-resistant cloth that may be governed by, tested against, or otherwise relevant to associated standards for cut resistance. In some instances, these standards may be defined and/or enforced by standards bodies or government agencies. As would be evident to one of ordinary skill in the art, from time to time these standards may be updated or revised to alter the requirements for satisfying the standard (e.g., in order to reduce injuries or other accidents). By way of example, a cut-resistance standard may be updated in response to analysis of accident statistics and/or in response to improved technologies. The cut-resistant yarn structures described herein are comprised of a combination of different techniques for achieving increased resistance to cutting. The use of a combination of techniques rather than simply using one technique may promote achieving a plurality of at least partly antagonistic objectives and/or to balance the properties of a given design. With reference to the cut-resistance standard provided by the American National Standards Institute (ANSI), the cut-resistant yarn structures of the present application may be used to satisfy ANSI cut level A8 and A9. However, the present disclosure notes that satisfying or exceeding the requirements of the ANSI cut-resistance standard or any other standard for cut-resistance is not required by the cut-resistant yarn structures described herein.

Cut-Resistant Yarn Structure

Figure 3A:
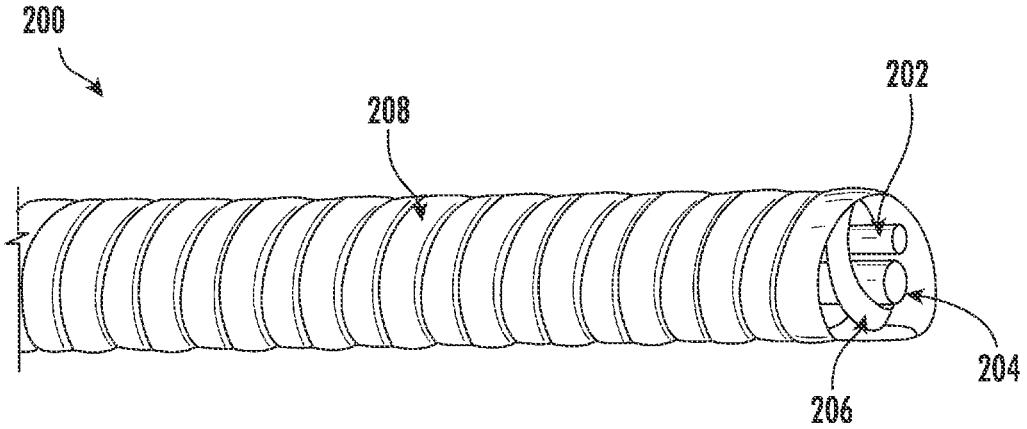
FIGS. 3A-3B illustrate a cut-resistant yarn structure according to an example embodiment.
Figure 3B:
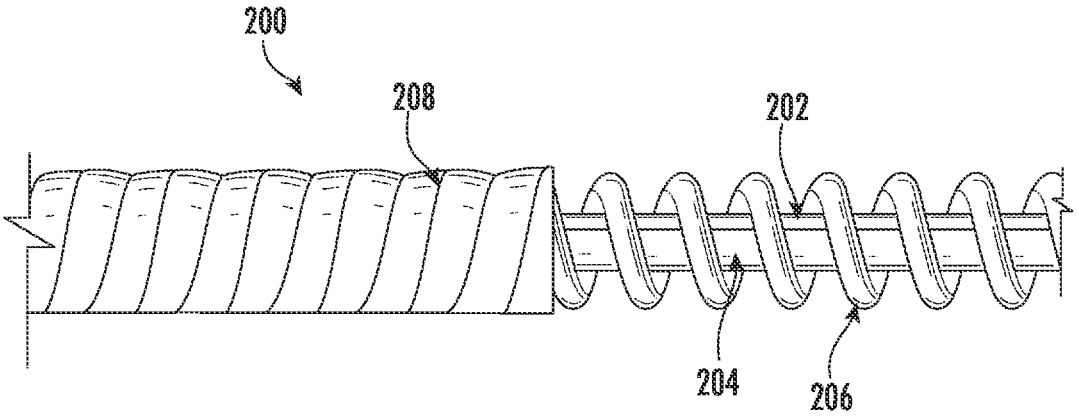

With reference to FIGS. 3A-3B, an example cut-resistant yarn structure 200 ("yarn structure 200") of the present disclosure is illustrated. As shown, the yarn structure 200 includes a first cut-resistant core filament 202, a second cut-resistant core filament 204, a first covering yarn 206, and a covering layer 208. In some embodiments, the first cut-resistant core filament 202 and the second cut-resistant core filament 204 may be located proximate one another in a longitudinal orientation (e.g., located adjacent and parallel to one another). Said differently, the first cut-resistant core filament 202 and the second cut-resistant core filament 204 may not be wound or otherwise twisted about one another. In some alternative embodiments (not shown), the first cut-resistant core filament 202 and the second cut-resistant core filament 204 may be wound or otherwise twisted about one another prior to application of the first covering yarn 206 described hereafter. As shown in FIG. 3B in which the covering layer 208 is partially removed, the first covering yarn 206 is wound about the first cut-resistant core filament 202 and the second cut-resistant core filament 204 so as to secure the filaments 202, 204. As shown in FIG. 3A, the cut-resistant yarn structure 200 of the present disclosure may include one or more covering layers (e.g., covering layer 208) that are wound over the first covering yarn 206 (i.e., and by association the first cut-resistant core filament 202 and the second cut-resistant core filament 204).

In some example embodiments, the first cut-resistant core filament 202 and/or the second cut-resistant core filament 204 may include one of basalt, steel, or steel alloy. By way of example, the first cut-resistant core filament 202 may include a basalt material while the second cut-resistant core filament 204 may include a steel or steel alloy material. Due to the chemical and mechanical properties of these materials, the cut-resistance of the yarn structure 200 may be improved. While described with reference to a particular implementation, the present disclosure contemplates that any combination of the above materials for the first and second cut-resistant core filaments 202, 204 may be used based upon the intended use for the yarn structure 200. As described hereafter, in yarn structure embodiments with additional cut-resistant core filaments (e.g., five (5) cut-resistant core filaments), the present disclosure contemplates any number of combinations of the materials described herein. Furthermore, as would be understood by those of ordinary skill in the art, basalt filaments or basalt fibers may be manufactured from crushed basalt, melting the crushed basalt, extruding the molten basalt through nozzles to produce continuous filaments of basalt fiber, or the like. It will be appreciated that basalt filaments or basalt fibers may have a relatively small admixture of other substances or materials and yet retain the desired cut-resistant properties.

With continued reference to FIGS. 3A-3B, the covering layer 208 of the yarn structure 200 may serve as the exterior layer or element of the yarn structure 200. In some embodiments, the covering layer 208 may be formed of filaments (e.g., continuous fibers) or of staple yarn (e.g., fibers cut to a shorter length). Furthermore, based upon the intended application of the yarn structure 200, the covering layer 208 may include polyester, PE series-polyester, polyethylene, high performance polyethylene (HPPE), high molecular weight polyethylene (HMWPE), regenerated cellulose, moisture management material, or a blended combination thereof. In other embodiments, based upon the intended application of the yarn structure 200, the covering layer 208 may include fire retardant regenerated cellulose, polyimide, para-aramid, polyacrylonitrile (PAN), or a blended combination thereof. Furthermore, while described and illustrated with reference to a single covering layer 208, the present disclosure contemplates that any number of covering layers may be wound around the first covering yarn 206 (e.g. concurrently or in succession) so as to achieve the required dimensions of the yarn structure 200 and/or to configure the yarn structure for a particular use.

Figure 4:
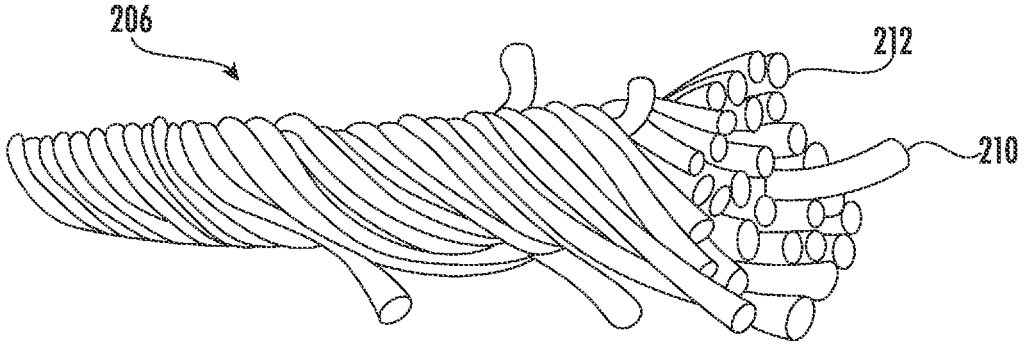
FIG. 4 illustrates a first core-spun covering yarn of FIGS. 3A-3B according to an example embodiment.

With reference to FIG. 4, an example first covering yarn 206 is illustrated. As described with reference to FIGS. 3A-3B above, the first covering yarn 206 is wound over the first cut-resistant core filament 202 and the second cut-resistant core filament 204. As shown in FIG. 4, the first covering yarn 206 may be a core-spun yarn in which staple fibers 212 are spun over a third cut-resistant core filament 210. The core-spun first covering yarn 206 may include a third cut-resistant core filament 210 and a plurality of staple fibers 134 that are spun over the third cut-resistant core filament 210. As above with the first cut-resistant core filament 202 and the second cut-resistant core filament 204, the third cut-resistant core filament 210 may comprise one of basalt, steel, or steel alloy. The staple fibers 212 may be fibers that are inherently relatively short or may be formed by cutting long fibers into shorter, staple-length fibers. In an example embodiment, the staple fibers 212 may comprise polyester, PE series-polyester, polyethylene, high performance polyethylene (HPPE), high molecular weight polyethylene (HMWPE), regenerated cellulose, fire retardant regenerated cellulose, polyimide, para-aramid, polyacrylonitrile (PAN), or any blended combination thereof. In other embodiments, based upon the intended application of the yarn structure 200, the staple fibers 212 may include fire retardant regenerated cellulose, polyimide, para-aramid, polyacrylonitrile (PAN), or a blended combination thereof.

Figure 5:
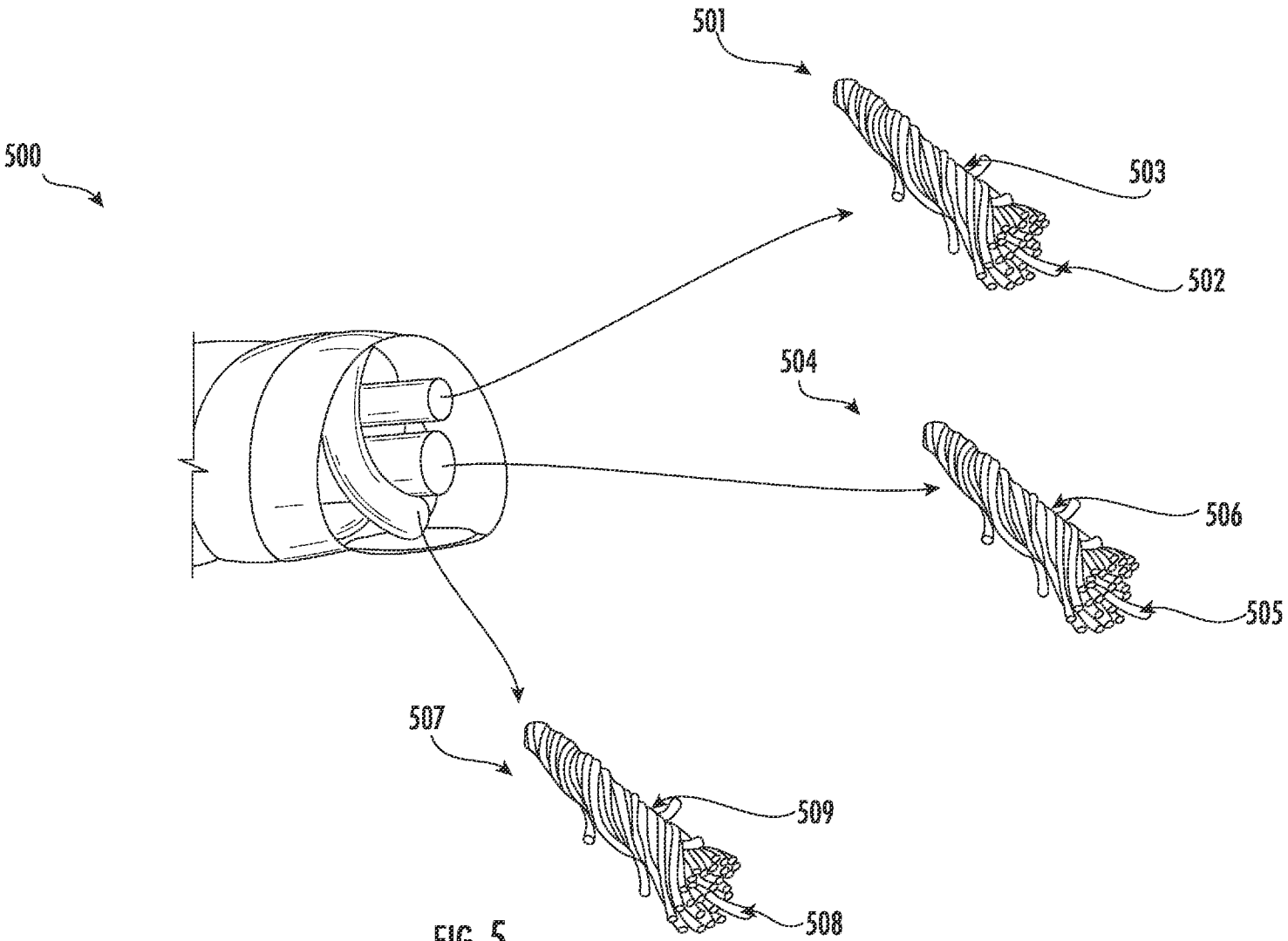
FIG. 5 illustrates another cut-resistant yarn structure in which a first and a second core filament include core-spun yarns according to an example embodiment.

With reference to FIG. 5, another example cut-resistant yarn structure 500 (e.g., yarn structure 500) is illustrated. As shown, the yarn structure 500 includes a first cut-resistant core filament 501, a second cut-resistant core filament 504, and a first covering yarn 507. In some example embodiments, the first cut-resistant core filament 501 may define a core-spun yarn in which staple fibers 503 are spun over the first cut-resistant core filament 502. Similarly, the second cut-resistant core filament 504 may define a core-spun yarn in which staple fibers 506 are spun over the first cut-resistant core filament 505. The covering yarn 507 may operate similar to the yarn structure 200 and the first core-spun covering yarn 206 of FIG. 4. As above, the first cut-resistant core filament 502, the second cut-resistant core filament 505, and the third cut-resistant core filament 508 may include one of basalt, steel, or steel alloy. The staple fibers 503, 506, 509 may be fibers that are inherently relatively short or may be formed by cutting long fibers into shorter, staple-length fibers. In an example embodiment, the staple fibers 503, 506, 509 may include polyester, PE series-polyester, polyethylene, high performance polyethylene (HPPE), high molecular weight polyethylene (HMWPE), regenerated cellulose, fire retardant regenerated cellulose, polyimide, para-aramid, polyacrylonitrile (PAN), or any blended combination thereof. In other embodiments, based upon the intended application of the yarn structure 500, the staple fibers 503, 506, 509 may include fire retardant regenerated cellulose, polyimide, para-aramid, polyacrylonitrile (PAN), or a blended combination thereof.

While only illustrated and described herein with reference to a first cut-resistant core filament and a second cut-resistant core filament (which may or may not be core-spun), the present disclosure contemplates any number of cut-resistant core filaments wrapped at least by a first core-spun covering yarn. By way of example, a cut-resistant yarn structure (not shown) may include five (5) cut-resistant core filaments wrapped by a first core-spun covering yarn. As described above, each of these five (5) cut-resistant core filaments may be formed of a basalt material, steel material, or a steel allow, in any combination.

Figure 6:
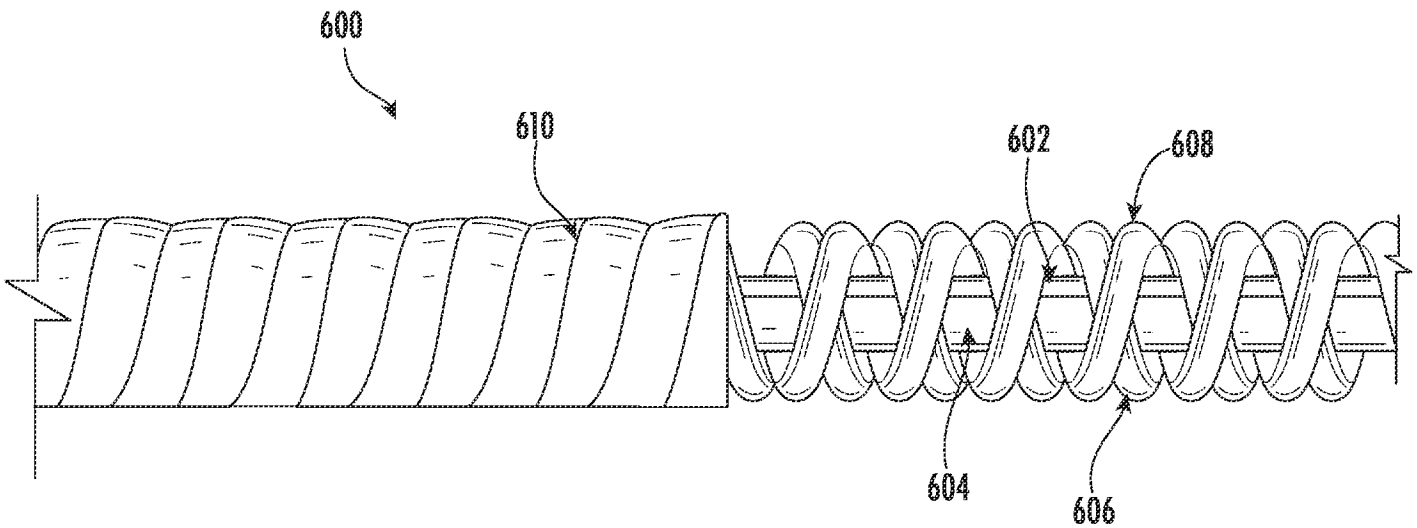
FIG. 6 illustrates another cut-resistant yarn structure including a second core-spun covering yarn according to an example embodiment.

With reference to FIG. 6, another example cut-resistant yarn structure 600 (e.g., yarn structure 600) is illustrated. As shown, the yarn structure 600 includes a first cut-resistant core filament 602, a second cut-resistant core filament 604, a first covering yarn 608, and a second covering yarn 608. Similar to the embodiments described above, the first covering yarn 606 and the second covering yarn 608 are wound over the first cut-resistant core filament 602 and the second cut-resistant core filament 604. As shown in FIG. 4 above, the first covering yarn 606 and the second covering yarn 608 may be core-spun yarns in which staple fibers are spun over a cut-resistant core filament (e.g., a third cut-resistant core filament and a fourth cut-resistant core filament, respectively). The fourth cut-resistant core filament (not shown) and the staple fibers (not shown) of the second covering yarn 608 may be formed of similar materials as those described with reference to FIG. 4.

While only illustrated and described herein with reference to a first core-spun covering yarn and a second core-spun covering yarn, the present disclosure contemplates any number of core-spun yarns wound around any number of cut-resistant core filaments. By way of example, an example cut-resistant yarn structure (not shown) may include five (5) covering yarns wound around two (2) to five (5) cut-resistant core filaments.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A cut-resistant yarn structure comprising:

a first cut-resistant core filament;

a second cut-resistant core filament;

a first covering yarn wound over the first cut-resistant core filament and the second cut-resistant core filament, wherein the first covering yarn comprises a core-spun yarn in which staple fibers are spun over a third cut-resistant core filament; and a second covering yarn, along with the first covering yarn, wound over the first cut-resistant core filament and the second cut-resistant core filament, wherein the second covering yarn comprises a core-spun yarn in which staple fibers are spun over a fourth cut-resistant core filament.

2. The cut-resistant yarn structure according to claim 1, wherein the first cut-resistant core filament comprises one of basalt, steel, or steel alloy.

3. The cut-resistant yarn structure according to claim 1, wherein the second cut-resistant core filament comprises one of basalt, steel, or steel alloy.

4. The cut-resistant yarn structure according to claim 1, wherein the third cut-resistant core filament comprises one of basalt, steel, or steel alloy.

5. The cut-resistant yarn structure according to claim 1, wherein the staple fibers of the core-spun yarn of the first covering yarn comprise polyester, PE series-polyester, polyethylene, high performance polyethylene (HPPE), high molecular weight polyethylene (HMWPE), regenerated cellulose, moisture management material, or a blended combination thereof.

6. The cut-resistant yarn structure according to claim 1, wherein the staple fibers of the core-spun yarn of the first covering yarn comprise fire retardant regenerated cellulose, polyimide, para-aramid, polyacrylonifrile (PAN), or a blended combination thereof.

7. The cut-resistant yarn structure according to claim 1, wherein the first cut-resistant core filament comprises a core-spun yarn in which staple fibers are spun over the first cut-resistant core filament.

8. The cut-resistant yarn structure according to claim 1, wherein the second cut-resistant core filament comprises a core-spun yarn in which staple fibers are spun over the second cut-resistant core filament.

9. The cut-resistant yarn structure according to claim 1, further comprising one or more covering layers wound over the first covering yarn, wherein each of the one or more covering layers comprises polyester, PE series-polyester, polyethylene, high performance polyethylene (HPPE), high molecular weight polyethylene (HMWPE), regenerated cellulose, moisture management material, or a blended combination thereof.

10. The cut-resistant yarn structure according to claim 1, further comprising one or more covering layers wound over the first covering yarn, wherein each of the one or more covering layers comprises fire retardant regenerated cellulose, polyimide, para-aramid, polyacrylonitrile (PAN), or a blended combination thereof.

11. A method of manufacturing a cut-resistant yarn structure, the method comprising:

providing a first cut-resistant core filament;

providing a second cut-resistant core filament;

spinning staple fibers over a third cut-resistant core filament to form a core-spun yarn wherein the core-spun yarn is a first covering yarn winding the first covering yarn over the first cut-resistant core filament and the second cut-resistant core filament; and spinning staple fibers over a fourth cut-resistant core filament to form a core-spun yarn, wherein the core spun yarn is a second covering yarn; and winding the second covering yarn, along with the first covering yarn over the first cut-resistant core filament and the second cut-resistant core filament.

12. The method according to claim 11, wherein the first cut-resistant core filament comprises one of basalt, steel, or steel alloy.

13. The method according to claim 11, wherein the second cut-resistant core filament comprises one of basalt, steel, or steel alloy.

14. The method according to claim 11, wherein the third cut-resistant core comprises one of basalt, steel, or steel alloy.

15. The method according to claim 11, wherein the staple fibers of the core-spun yarn of the first covering yarn comprise polyester, PE series-polyester, polyethylene, high performance polyethylene (HPPE), high molecular weight polyethylene (HMWPE), regenerated cellulose, moisture management material, or a blended combination thereof.

16. The method according to claim 11, wherein the staple fibers of the core-spun yarn of the first covering yarn comprise fire retardant regenerated cellulose, polyimide, para-aramid, polyacrylonitrile (PAN), or a blended combination thereof.

17. The method according to claim 11, wherein providing the first cut-resistant core filament comprises spinning staple fibers over the first cut-resistant core filament to form a core-spun yarn.

18. The method according to claim 11, wherein providing the second cut-resistant core filament comprises spinning staple fibers over the second cut-resistant core filament to form a core-spun yarn.

* * * * *